US006874251B2

(12) United States Patent
Moretti

(10) Patent No.: US 6,874,251 B2
(45) Date of Patent: Apr. 5, 2005

(54) WATERPROOFED VAPOR-PERMEABLE SOLE FOR SHOES

(75) Inventor: Mario Polegato Moretti, Crocetta Del Montello (IT)

(73) Assignee: GEOX S.p.A., Montebelluna (IT)

( * ) Notice: Subject to any disclaimer, the term of this patent is extended or adjusted under 35 U.S.C. 154(b) by 187 days.

(21) Appl. No.: 09/765,605

(22) Filed: Jan. 22, 2001

(65) Prior Publication Data

US 2001/0010127 A1 Aug. 2, 2001

(30) Foreign Application Priority Data

Jan. 31, 2000 (IT) ..... PD2000A0027

(51) Int. Cl.[7] ..... A43B 7/06; A43B 7/08
(52) U.S. Cl. ..... 36/3 B; 36/3 R; 36/29
(58) Field of Search ..... 36/29, 28, 32 R, 36/3 B, 84, 98, 102, 103, 14, 55, 4, 59 C, 11.5, 8.1, 3 R, 3 A

(56) References Cited

U.S. PATENT DOCUMENTS

| | | | | | |
|---|---|---|---|---|---|
| 429,429 | A | | 6/1890 | Eckhardt | |
| 760,401 | A | * | 5/1904 | Sandmeyer | 36/3 R |
| 1,168,166 | A | * | 1/1916 | Cook | |
| 2,347,207 | A | * | 4/1944 | Margolin | 36/3 R |
| 4,682,425 | A | * | 7/1987 | Simmons | 36/44 |
| 4,771,555 | A | * | 9/1988 | Ohashi | 36/3 R |
| 5,044,096 | A | * | 9/1991 | Polegato | 36/3 R |
| 5,044,096 | A | * | 12/1998 | Polegato | 36/3 R |
| 5,983,524 | A | * | 11/1999 | Polegato | 36/3 R |
| 5,992,052 | A | * | 11/1999 | Moretti | 36/3 B |
| 6,282,813 | B1 | * | 9/2001 | Squadroni | 36/3 B |

FOREIGN PATENT DOCUMENTS

| | | | | |
|---|---|---|---|---|
| EP | 0 382 904 | | 8/1990 | |
| EP | 0382904 | * | 8/1990 | 36/3 R |
| EP | 0479183 | * | 4/1992 | 36/3 R |
| EP | 0 619 959 | | 10/1994 | |
| GB | 1 265 459 | | 3/1972 | |
| WO | WO 98/47399 | | 10/1998 | |

* cited by examiner

*Primary Examiner*—Anthony Stashick
(74) *Attorney, Agent, or Firm*—Oblon, Spivak, McClelland, Maier & Neustadt, P.C.

(57) ABSTRACT

A waterproofed and vapor-permeable sole for shoes, comprising a tread which is made of leather or similar material and is at least partially covered in an upward region by a membrane made of a material which is permeable to vapor and impermeable to water and is sealed in its peripheral regions with respect to the tread. The tread has through holes in which inserts made of plastic material such as rubber or the like are assembled hermetically, the inserts in turn having through holes.

8 Claims, 1 Drawing Sheet

WATERPROOFED VAPOR-PERMEABLE SOLE FOR SHOES

BACKGROUND OF THE INVENTION

The present invention relates to a waterproofed vapor-permeable sole for shoes.

It is known that the main problem noted when using shoes provided with an ordinary sole made of natural material such as leather or the like is constituted by wet environments.

When rain and bad weather cause the streets to be wet and slippery, it is in fact not advisable to use shoes with a leather sole, since leather, indeed because of its characteristic of being vapor-permeable and healthy for the foot, is not impermeable but indeed absorbs water.

The thinner the leather, the faster it becomes impregnated with water or moisture until it wets the user's foot.

Another drawback is that the leather tread is not patterned but is smooth or sometimes even polished with waxes.

This is a further problem in wet environments, since grip is unsteady in such conditions.

Accordingly, the use of soles with a leather tread is constrained by weather conditions, and therefore shoes having this type of material are mainly provided in summer collections by shoe manufacturers.

An attempt to obviate this drawback has been made by inserting between the leather tread and the foot resting region an element made of polyurethane or PVC, which element however inhibits vapor permeation and relegates the use of leather to a purely aesthetic matter.

A sole, disclosed in EP-0 619 959 by the same Applicant, has also been devised which comprises a tread made of leather or similar material which is at least partially covered, in an upward region, by a membrane made of a material which is permeable to vapor and impermeable to water.

The thread is then assembled at least peripherally with at least one upper part made of rubber or similar material which has a plurality of through holes at least in the regions affected by the membrane.

Although it is a considerable technical step forward, since the leather tread is waterproofed, such sole has drawbacks, the main one being the very nature of leather, which is a vapor-permeable material, as mentioned, but whose perspiration degree is not high enough to rapidly dissipate all the heat and vapor that form during use inside the shoe.

SUMMARY OF THE INVENTION

The aim of the present invention is to further improve the vapor-permeability of a sole made of leather or the like waterproofed according to the method disclosed in EP-0 619 959.

A consequent primary object of the present invention is to provide a sole which also has good ground grip characteristics in all operating conditions.

Another object of the invention is to provide a sole which also has shock-proof characteristics.

Another object of the invention is to provide a sole which has the same features as currently commercially available soles having a leather tread.

Another object of the invention is to increase user comfort.

Another object of the invention is to provide a sole which can be manufactured at low cost and therefore can be sold at a competitive price.

Another object of the invention is to provide a sole which can be manufactured with known equipment and methods.

This aim and these and other objects which will become better apparent hereinafter are achieved by a waterproofed and vapor-permeable sole for shoes, characterized in that it comprises a tread which is made of leather or similar material and is at least partially covered in an upward region by a membrane made of a material which is permeable to vapor and impermeable to water and is sealed in its peripheral regions with respect to said tread, said tread having through holes in which inserts made of plastic material such as rubber or the like are assembled hermetically, said inserts in turn having through holes.

BRIEF DESCRIPTION OF THE DRAWINGS

Further characteristics and advantages of the invention will become better apparent from the following detailed description of an embodiment thereof, illustrated only by way of non-limitative example in the accompanying drawings, wherein.

DESCRIPTION OF THE PREFERRED EMBODIMENTS

Figure 1:
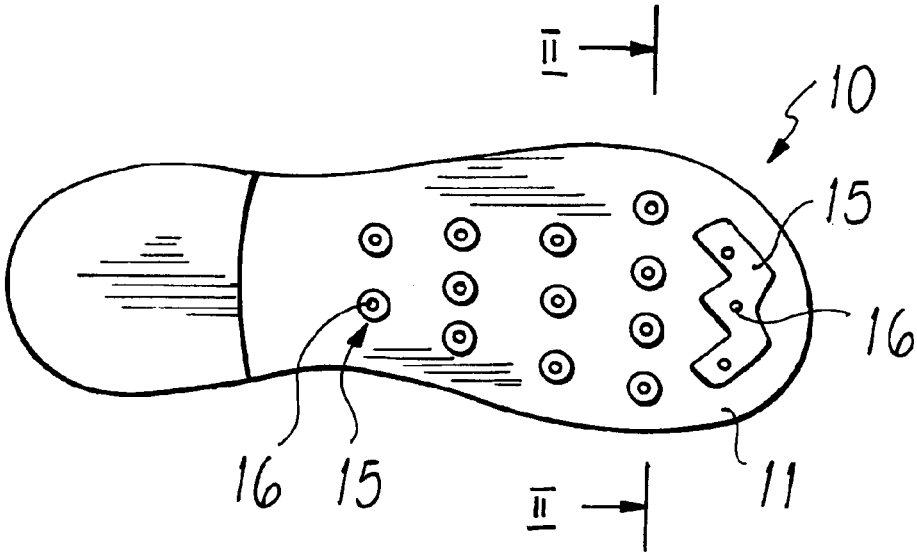
FIG. 1 is a plan bottom view of a sole according to the invention.
Figure 2:
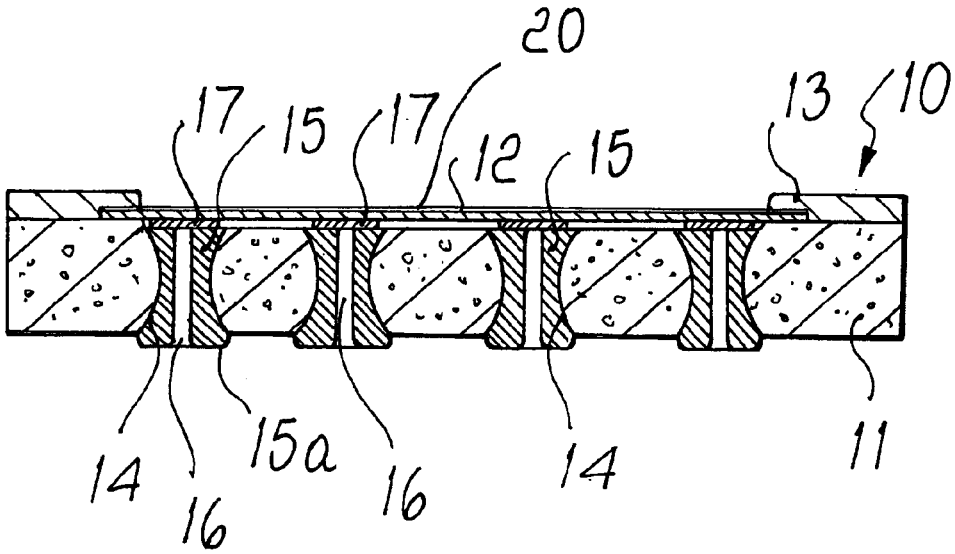
FIG. 2 is a transverse sectional view of the sole of FIG. 1, taken along the line II—II.

With reference to the figures, a waterproofed and vapor-permeable sole according to the invention is generally designated by the reference numeral 10 and comprises a tread 11 which is made of leather or similar material and is covered in an upward region, substantially in a plantar region, by a membrane 12 which is impermeable to water and permeable to vapor and is preferably made of a material such as the one commonly known as Gore-Tex.

In this case, the membrane 12 is peripherally spaced from the edge of the tread 11, and a peripheral upper trim 13 made of rubber, polyurethane, PVC or other equivalent material is assembled on the tread 11, for example by injection in a mold, covering and sealing the peripheral regions of the membrane 12 and leaving a large central opening in which the membrane is visible.

As an alternative, the membrane 12 can have the same dimensions as the tread 11 and its edge can be sealed along the entire perimeter therewith by means of appropriate adhesive of the hot-melt type, based on water or solvents or the like.

This is done to allow the upward fixing of the welt and of the upper.

The membrane 12 constitutes a water barrier yet preserving the vapor-permeability characteristics of the leather.

According to the invention, the tread 11 has through holes 14 in which inserts 15 made of rubber or similar material are assembled, for example by injection in a mold; the inserts also form antislip and wear-preventing protrusions 15*a* underneath the tread 11.

The inserts 15 are shaped so as to provide undercuts which are adapted to avoid their disassembly from the tread 11.

In the present case, the configuration from the top downward provides for widths which decrease and then increase.

The inserts 15 are further provided with through holes 16 which connect the region below the membrane 12 to the region below the tread 11.

This is done in order to improve the vapor-permeation action of the material that constitutes the tread 11.

It can be convenient to arrange at least one vapor-permeable protective layer 17, such as felt or the like, at upper outlets of the holes 16, so as to protect the membrane 12 against blunt bodies such as pebbles or the like, which can penetrate and spoil it.

It should also be noted that it may be advisable to arrange over the membrane 12 a vapor-permeable or perforated protective layer 20, such as felt, light jersey, non-woven fabric or the like.

This layer is a rather flimsy film which requires adequate protection in order to be treated or otherwise assembled with the other components of the sole 10.

In practice it has been observed that the intended aim and objects of the invention have been achieved.

The sole in fact has improved qualitative characteristics in terms of vapor permeation with respect to waterproofed leather soles, thanks to the presence of the holes 16, and also features antislip characteristics due to the presence of the inserts 15 with protrusions 15*a* in which the holes 16 are provided.

It should also be noted that it can be manufactured without particular difficulties with ordinary manufacturing methods.

The invention thus conceived is susceptible of numerous modifications and variations, all of which are within the scope of the inventive concept.

All the details may furthermore be replaced with other technically equivalent elements.

In practice, the materials employed, so long as they are compatible with the contingent use, as well as the dimensions, may be any according to requirements.

The disclosures in Italian Patent Application No. PD2000A000027 from which this application claims priority are incorporated herein by reference.

What is claimed is:

1. A waterproofed and vapor-permeable sole for shoes, comprising:

a tread made of leather and at least partially covered in an upward region by a membrane made of a material which is permeable to vapor, which is impermeable to water, and which is sealed in peripheral regions thereof with respect to said tread;

through holes extending entirely through a thickness of said tread;

inserts made of plastic material assembled in said through holes, said inserts in turn having through holes therethrough for allowing vapor to pass through said through holes through the thickness of said tread.

2. The sole according to claim 1, wherein said inserts form antislip and wear-preventing protrusions underneath said tread.

3. The sole according to claim 1, wherein said membrane is peripherally spaced from the edge of said tread and further comprising a peripheral upper trim, which is made of rubber, and which is assembled to said tread so as to cover and seal peripheral regions of said membrane and so as to leave a wide central opening through which said membrane is visible.

4. The sole according to claim 1, wherein the dimensions of said membrane are equal to those of the tread and wherein the edge of the membrane is sealed to the tread along all the perimeter of the membrane by means of adhesive.

5. The sole according to claim 1, wherein at least one protective layer is arranged at least at upper outlets of said holes of said inserts assembled in said tread so as to protect said membrane.

6. The sole according to claim 1, wherein said inserts form, in said tread, undercuts which prevent disassembly of the inserts from said tread.

7. The sole according to claim 1, wherein a vapor-permeable and/or perforated protective layer is arranged above said membrane.

8. The sole according to claim 1, wherein said inserts are assembled to said tread by injection-molding.

* * * * *